United States Patent [19]

Davis

[11] 3,991,848

[45] Nov. 16, 1976

[54] ACOUSTICAL BOARD

[75] Inventor: George G. Davis, Cos Cob, Conn.

[73] Assignee: Frigitemp, New York, N.Y.

[22] Filed: Aug. 16, 1974

[21] Appl. No.: 497,952

[52] U.S. Cl. ..... 181/33 G; 428/138

[51] Int. Cl.[2] ..... E04B 1/99

[58] Field of Search ..... 181/33 G; 161/112

[56] References Cited

UNITED STATES PATENTS

| | | | |
|---|---|---|---|
| 2,984,312 | 5/1961 | Brisley | 181/33 G |
| 3,002,868 | 10/1961 | Bivin | 181/33 G |
| 3,141,804 | 7/1964 | Di Maio et al. | 181/33 G |
| 3,269,484 | 8/1966 | Lighter | 181/33 G |
| 3,384,199 | 5/1968 | Eckel | 181/33 G |
| 3,433,322 | 3/1969 | Olsson | 181/33 G |
| 3,525,417 | 8/1970 | Giraudeau | 181/33 G |
| 3,770,560 | 11/1973 | Elder | 161/112 |

*Primary Examiner*—L. T. Hix
*Assistant Examiner*—Vit W. Miska
*Attorney, Agent, or Firm*—Herbert C. Schulze

[57] ABSTRACT

This invention is a new and unique acoustical board formed of fire retardant materials which board has the unique qualities of being fire retardant, sound absorbing, heat insulating, and decorative, and may be formed virtually in any desired size and shape. It is composed of fiberglass reinforced melamine resin panels or the like having one grooved surface covered by fiberglass cloth with perforations suitable to admit sound waves into the grooved areas of the underlying board in such manner as to trap, and debilitate such sound waves therein.

2 Claims, 3 Drawing Figures

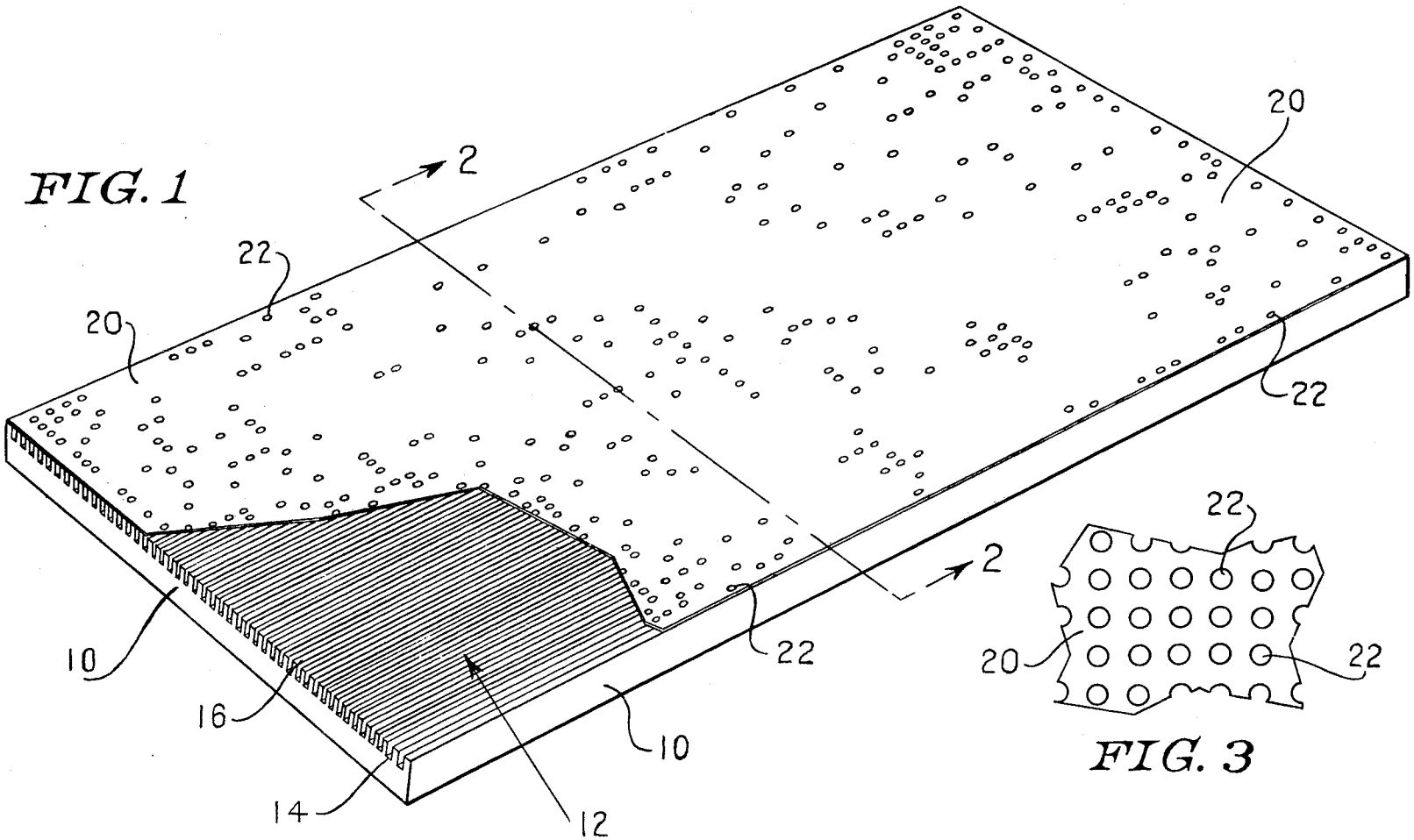
FIG. 1
FIG. 3
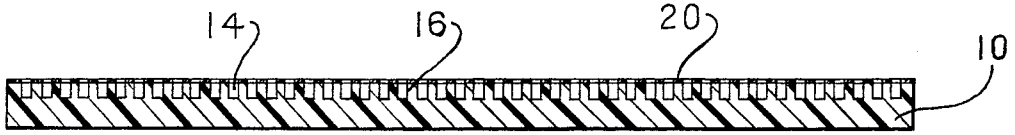
FIG. 2

ACOUSTICAL BOARD

CROSS REFERENCE TO RELATED PATENT APPLICATIONS

There are no related patent application filed by me.

BACKGROUND OF THE INVENTION

1. Field of the Invention

This invention is in the general field of sound deadening materials used in buildings or other areas and is more particularly in the field of a sound deadening material which is also fire resistant and of low thermal conductivity.

2. Description of the Prior Art

There are great quantities of acoustical materials of various configuration and composition used in buildings and other confined areas. Such materials may be of loosely woven fibre, perforated elements, specially shaped elements, and the like. Each of such materials have certain characteristics; such as, absorption, transfer, passage, reflection, or the like, of sound waves coming in contact with the material.

Most of the materials used for this purpose are unsuited to many applications for a wide variety of reasons. In some instances the material is unsuited to conditions of cleanliness which may be desired (due to dusting and the like) or because of the necessity of complete protection against fires or moisture, or for a variety of other reasons.

The present invention is a material which entraps sound waves and is non-dusting, is fire retardant, and is generally unaffected by chemicals. It is capable of economical formation in large segments and segments of irregular shapes. It is capable of formation, assembly, and repair in an economical manner in the field.

SUMMARY OF THE INVENTION

Increasing attention is being paid to the problems of the sound environment of rooms, ships, containers, vehicles, and the like.

There are many special requirements for the environment of certain activites, and the like. In some instances prime consideration must be given to acoustic quality perfection; In other cases prime consideration may be to sanitation with secondary consideration to acoustical qualities; In other situations protection against corrosion and the like is a prime consideration; In still other conditions thermal isolation is of prime interest; Under some circumstances fire proofing is of prime interest. Under all circumstances, the highest condition of acoustical characterstic is desired, consistent with the other requirements.

In attempting to achieve acoustical characteristic perfection, numerous acoustical materials have been developed including specially shaped materials, porous materials, and other materials known to those skilled in the art.

One thing which has been most difficult is to find a material which combines desired results in such manner that: It does not support combustion; It does not entrap moisture; It is unaffected by moisture; It is unaffected by chemical activity; It is non-toxic; It is non-dusting; It is of pleasing appearance; And, it effectively imparts desired acoustical characteristics to its environment.

Of less importance, but still of consequence, is the desire to be able to form materials as required to accomodate unusual shapes and conditions and to achieve field fabrication. Also, it is most desirable to be able to repair damage, stains, and the like without major rehabilitation or replacement.

I have devoted considerable attention to this problem of providing a suitable acoustical material to attempt to achieve all of the normally desired acoustical arresting qualities, and at the same time to overcome the numerous limitations of other materals and accomplish all of the ends as herein previously outlined.

I have conceived a new unique material in a particular form, which accomplishes the hitherto unobtainable goals of (1) providing an acoustical material which will entrap sound waves within it; And (2) at the same time having qualities of being nonporous, non-dusting, unaffected by normal moisture and chemical conditions, easily formed in nearly any configuration, is fire retardant, attractive, and repairable if damaged without complete replacement.

I have accomplished all of this by a specially constructed melamine material, reinforced with glass fibers, and provided with a multiplicity of grooves of a particular configuration, which is entirely covered on the grooved side (the side exposed to sound waves) with a fiberglass cloth having particularly disposed perforations therein which cooperate with the grooves so as to allow the entry of sound waves through the perforations and to allow the travel through the grooves with entrapment therein during which entrapment the energy of the sound waves is dissipated.

It is an object of this invention to provide an acoustical board having the characteristics of above mentioned;

Another object of this invention is to provide such as acoustical board which can be made assembled and installed easily in the location in which it is to be used;

Another object of this invention is to provide such as acoustical board wherein the sound waves are entrapped and dissipated.

The foregoing and other objects and advantages of this invention will become apparent to those skilled in the art upon reading the description of a preferred embodiment which follows, in conjunction with a review of the appended drawings.

BRIEF DESCRIPTION OF THE DRAWINGS

FIG. 1 is a perspective of a preferred embodiment of an acoustical board of this invention, with certain portions broken away;

FIG. 2 is a section on 2—2 of FIG. 1; and

FIG. 3 is an enlarged, plan view of a segment of the covering of the material.

DESCRIPTION OF A PREFERRED EMBODIMENT

Attention to FIG. 1 will result in the understanding that this invention comprises a board of melamine, or its equal, 10, which may be of any desired configuration. For simplicity of illustration, and because this configuration constitutes the bulk of the material so used, a rectangular piece has been shown. It is to be understood that the piece could be circular, triangular, or any irregular shape. The shape and size will be dictated by the area being covered with the material.

It is to be observed that the surface of the melamine 12 is grooved as indicated, with grooves 14 having upstanding ridges 16 between them, as indicated.

The grooved area is covered by a sheet of fiberglass cloth or the equivalent 20, which has numerous perforations 22 on its surface. Only representative perforations have been shown, but in practice, the perforations will be uniform over the entire surface of the covering 20, and such perforations will be of the size and configuration such as to allow the passage of sound waves into the grooved area for dispersion and dissipation.

The representative configuration of the holes in the covering 20 is clear by an examination of FIG. 3 in which it is shown that they are aligned in such manner that they will be in alignment with the grooves.

FIG. 2 illustrates no additional elements, but it will be clear from FIG. 2 that the melamine board 10 having upstanding ridges 16, with grooves 14, is covered by the glass fiber cloth 20 in such manner that the holes are in alignment for admitting the sound waves for dispersion within the grooves.

There are critical dimensions within limitations, as follows: The melamine board, which may be pure melamine or may consist of glass fibers impregnated with the melamine binder, will normally have a thicknes of 1 or 2 inches as may be required by the particular application.

The grooves, preferably, will be 3/16 inch to ⅜ inch in depth, 3/16 inch in width, and spaced upon ½ inch centers from one another.

The glass fiber cloth, preferably, may be impregnated with some resin or other material to impart stiffness, and, preferably, will be perforated with 3/16 inch diameter holes, spaced ½ inch from each other in all directions measured from center. Thus, it will be seen, that the holes will be aligned above the grooves and will approximately encompass the width of the grooves.

When formed in these dimensions, this material has a sound absorption co-efficient as indicated in the following table. In each case, the sound absorption coefficient will be found to be equal to, or greater than, that shown.

| Board Thickness Inches | Frequency, cycles per second | | | | | |
|---|---|---|---|---|---|---|
| | 125 | 250 | 500 | 1000 | 2000 | 4000 |
| 1 | 0.06 | 0.25 | 0.70 | 0.90 | 0.75 | 0.70 |
| 2 | 0.22 | .70 | .90 | .85 | .75 | .75 |

While the embodiment of this invention, shown and described, is fully capable of achieving the objects and advantages desired, it will be clear to those skilled in the art, that modifications can be made without departing from the inventive concepts disclosed. The embodiment shown, is strictly for purposes of illustration.

I claim:

1. An acoustical facing material comprising a melamine board having a thickness between 1 and 2 inches, including a plurality of longitudinal ribs between 3/16 and ⅜ inch high on one side thereof, having grooves 3/16 inch wide between each pair of ribs, said grooves being ½ inch apart, and a fabric covering of glass fiber material impregnated with a stiffening agent covering the ribbed side of said board, said fabric material having holes intermediate said ribs 3/16 inch in diameter and spaced ½ inch on centers from each other in rows directly above the said grooves.

2. An acoustical facing material comprising: (1) a sheet of melamine not less than one, nor more than two, inches in thickness, having one side ribbed, said ribs being 3/16 inch in width, and being separated from one another by spaces not less than 3/16 inch, nor more than ⅜, inch in depth, and said ribs being spaced upon ½ inch centers from one another; and, (2) a glass fiber cloth having holes 3/16 inch in diameter and spaced ½ inch on centers from each other in rows ½ inch on centers from each other, said glass fiber cloth be adhered to the ribs of said melamine board with the rows of holes above the centers of the spaces between said ribs.

* * * * *